US008251337B2

(12) United States Patent
Jordan

(10) Patent No.: US 8,251,337 B2
(45) Date of Patent: Aug. 28, 2012

(54) TREE STAND

(76) Inventor: Alec Jordan, Winnipeg (CA)

( * ) Notice: Subject to any disclaimer, the term of this patent is extended or adjusted under 35 U.S.C. 154(b) by 380 days.

(21) Appl. No.: 12/607,270

(22) Filed: Oct. 28, 2009

(65) Prior Publication Data

US 2010/0108851 A1 May 6, 2010

Related U.S. Application Data

(60) Provisional application No. 61/109,536, filed on Oct. 30, 2008.

(51) Int. Cl.
*F16M 13/00* (2006.01)

(52) U.S. Cl. ..... 248/519; 47/40.5; 248/523; 248/528

(58) Field of Classification Search ..... 248/519, 248/523, 524, 528; 47/40.5
See application file for complete search history.

(56) References Cited

U.S. PATENT DOCUMENTS

| | | | | |
|---|---|---|---|---|
| 1,298,380 | A | | 3/1919 | Owen |
| 1,570,403 | A | | 1/1926 | Ripczinske |
| 2,237,513 | A | | 4/1941 | Timko |
| 2,500,215 | A | | 3/1950 | Swearingen |
| 2,617,617 | A | | 11/1952 | Krastel et al. |
| 2,750,138 | A | | 6/1956 | Morris |
| 2,855,168 | A | | 10/1958 | Vigna |
| 2,938,304 | A | | 5/1960 | Thomas et al. |
| 3,119,585 | A | | 1/1964 | Austenson |
| 3,484,067 | A | | 12/1969 | Fulper |
| 3,784,136 | A | | 1/1974 | Lopez |
| 4,261,138 | A | | 4/1981 | Syms |
| 4,286,409 | A | | 9/1981 | Taylor et al. |
| 4,399,973 | A | | 8/1983 | Spry et al. |
| 4,436,272 | A | | 3/1984 | Lile et al. |
| 4,565,028 | A | | 1/1986 | Stephan |
| 4,967,508 | A | | 11/1990 | Reynolds |
| 4,976,411 | A | | 12/1990 | Gordon et al. |
| 4,989,820 | A | * | 2/1991 | Sterling ..... 248/523 |
| 5,014,461 | A | | 5/1991 | vom Braucke et al. |
| 5,074,514 | A | | 12/1991 | Smith |
| 5,157,868 | A | | 10/1992 | Munoz |
| 5,249,772 | A | | 10/1993 | Montie, Jr. et al. |
| 5,478,042 | A | | 12/1995 | Bliss et al. |
| 5,484,131 | A | | 1/1996 | Aldrete et al. |
| 5,725,193 | A | | 3/1998 | Adams |
| 5,794,378 | A | * | 8/1998 | Beatrez ..... 47/32 |
| 5,938,168 | A | | 8/1999 | Adams |

* cited by examiner

*Primary Examiner* — Ramon Ramirez
(74) *Attorney, Agent, or Firm* — Ade & Company Inc; Kyle R Saterthwaite; Ryan W Dupuis

(57) ABSTRACT

A tree stand for supporting a cut tree in an upright position by its trunk features a sheet of flexible resilient material cut to form a plurality of retaining flaps extending inwardly from a perimeter portion of the sheet toward a centre thereof such that the retaining flaps will flex away from the perimeter portion of the sheet under forcing of a cut end of the tree's trunk against the center of the sheet to allow passage of a portion of the trunk therethrough while resiliently biasing back toward the perimeter portion of the sheet to engage a periphery of the tree's trunk. A support structure defines a base and supports the sheet at a distance upward from a plane of the base such that the tree's trunk passing through the sheet is held by the retaining flaps in a position projecting upwardly away from the plane of the base.

19 Claims, 12 Drawing Sheets

TREE STAND

This application claims benefit under 35 U.S.C. 119(e) of U.S. Provisional Patent Application Ser. No. 61/109,536, filed Oct. 30, 2008.

FIELD OF THE INVENTION

This invention relates generally to a tree stand, and more particularly to a tree stand for supporting a cut tree, such as a Christmas tree, in an upright position by the tree's trunk.

BACKGROUND OF THE INVENTION

A conventional Christmas tree stand uses several screw actuated trunk engaging mechanisms projecting horizontally inward in a radial direction toward a central vertical axis of the stand, along which the Christmas tree is to be positioned. Setting up of a tree using such a stand can be time consuming and awkward due to the need to individually adjust the plurality of screw mechanisms at a position below the branches of the tree. It is therefore desirable to produce a user friendly stand that provides a more efficient and more effortless process for setup of a Christmas tree or the like.

SUMMARY OF THE INVENTION

According to a first aspect of the invention there is provided a tree stand for supporting a cut tree in an upright position by the tree's trunk, the tree stand comprising:

a sheet of flexible resilient material cut to form a plurality of retaining flaps extending inwardly from a perimeter portion of the sheet toward a centre thereof such that the retaining flaps will flex away from the perimeter portion of the sheet under forcing of a cut end of the tree's trunk against the center of the sheet to allow passage of a portion of the trunk therethrough while resiliently biasing back toward the perimeter portion of the sheet to engage a periphery of the tree's trunk; and a support structure defining a base and arranged to support the sheet at a distance upward from a plane of the base with the sheet in an orientation extending along said plane such that the tree's trunk passing through the sheet is held by the retaining flaps in a position projecting upwardly away from the plane of the base.

Preferably the support structure comprises a closed bottom container having an open upper end at which the sheet is supported.

Preferably the resilient flexible sheet is selectively lockable to the container and removable therefrom.

Preferably there is provided a ring member on which the sheet is carried, the ring being removably mountable at the open upper end of the closed bottom container.

Preferably sliding of the ring member from the open upper end of the closed bottom container is blocked by a peripheral wall structure thereof.

The ring member may comprise downward projecting flange portions at different sides of the ring member that project downward along respective sides of the peripheral wall structure of the closed bottom container.

When such a flanged ring member is used, slots and projections are preferably defined on opposing ones of the downward projecting flange portions of the ring member and the peripheral wall structure of the closed bottom container and cooperable to selectively lock the ring member to the container.

Each slot preferably has a first vertical portion and a second horizontal portion, the ring member being lockable to the container by lowering the ring member onto the container to move the projections into the first vertical portions of the slots and then rotating the ring member to move the projections along the second horizontal portions of the slots to ends of the second horizontal portions opposite the first vertical portions.

Preferably the slots are defined in the flange portions of the ring member and the projections are defined on the peripheral wall of the container.

Preferably each retaining flap tapers in width from the perimeter portion of the sheet toward the center thereof.

Preferably spacing between adjacent retaining flaps tapers away from the center of the sheet toward the perimeter portion thereof.

The resilient flexible sheet may comprise eight retaining flaps.

There may be provided at least one additional sheet of flexible resilient material, each sheet having differently dimensioned retaining flaps to accommodate a differently sized tree trunk, whereby a user can pick from among the sheets of flexible resilient material to suit dimensions of a particular tree.

Preferably the base comprises a central portion defining the plane of the base and having a plurality of support flaps pivotally secured thereto for movement between storage positions adjacent a bottom side of the central portion opposite where the support structure is arranged to support the flexible resilient sheet and deployed positions projecting outward from the central portion in different directions along the plane of the base.

Preferably each support flap tapers in width away from a proximal end portion thereof at which said support flap is connected to the central portion.

Preferably the support flaps are non-overlapping even when pivoted into the storage positions adjacent the central portion.

Preferably a distal end of each support flap is situated inward of a perimeter of the central portion along the plane of the base with the support flaps in the storage positions.

Preferably there is provided a gripping feature supported on an upper side of the base to contact the tree's trunk below the sheet of flexible resilient material to further stabilize the cut tree.

Preferably the gripping feature comprises a plurality of projections projecting away from the base toward the sheet of flexible resilient material.

Preferably the projections comprise sharp tips at ends thereof opposite the base.

Preferably the projections comprise spikes.

Preferably the resilient flexible sheet comprises rubber.

The resilient flexible sheet may be more than ¼-inch thick, and may be more than ½-inch thick.

According to a second aspect of the invention there is provided a tree stand for supporting a cut tree in an upright position by the tree's trunk, the tree stand comprising:

a support structure defining a base; and a trunk engaging feature carried on the support structure and arranged to engage with the tree's trunk above the base to hold the cut tree in the upright position projecting away from the base;

the base comprises a central portion defining a plane of the base and having a plurality of support flaps pivotally secured thereto, the support flaps being movable, when the stand is not in use to support the tree, between storage positions adjacent a side of the central portion opposite the trunk engaging feature and deployed positions projecting outward from the central portion in different directions along the plane of the base.

Preferably each support flap is arranged to prevent pivoting thereof from the storage position past an orientation parallel to the plane of the base.

BRIEF DESCRIPTION OF THE DRAWINGS

In the accompanying drawings, which illustrate exemplary embodiments of the present invention.

DETAILED DESCRIPTION

Figure 3:
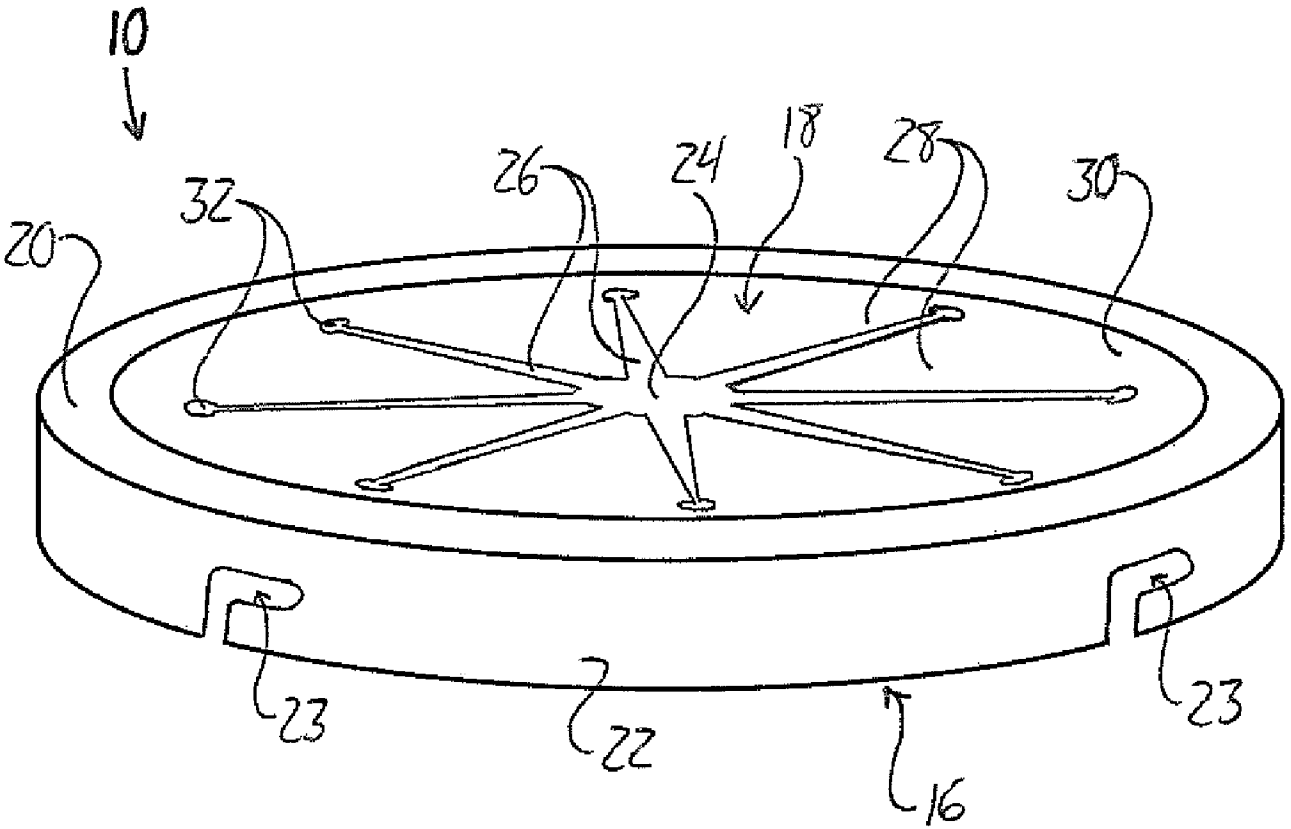
FIG. 3 is schematic assembled perspective view of a lid of the first embodiment tree stand, featuring the gasket and rim of FIGS. 1 and 2.
Figure 4:
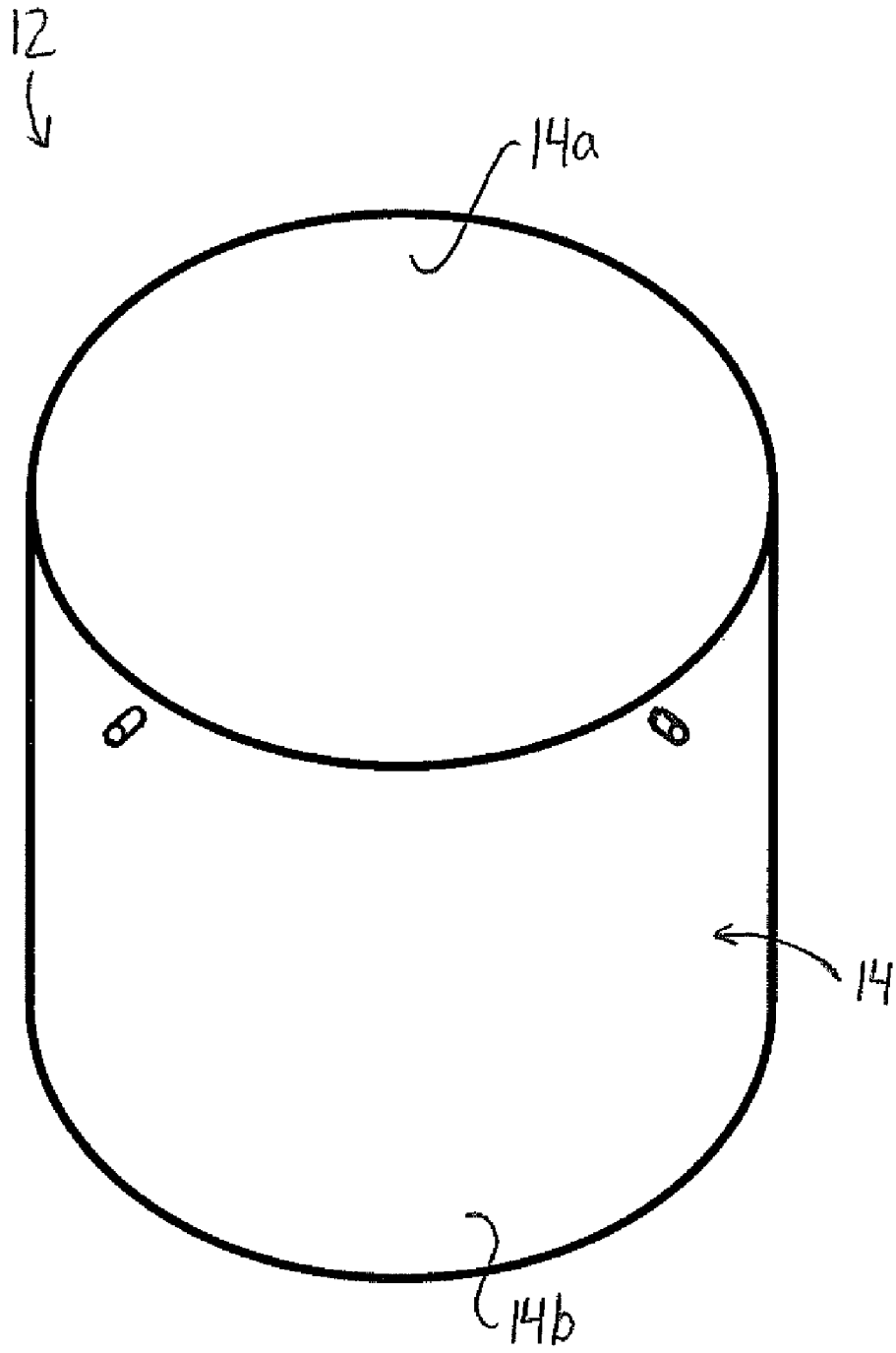
FIG. 4 is a schematic perspective view of a container of the first embodiment tree stand.

FIGS. 3 and 4 respectively show a lid 10 and a container or canister 12 of a Christmas tree stand according to an embodiment of the present invention. The container 12 is of a known conventional cylindrical shape and thus has a central longitudinal axis about which its cylindrical shape closes, a circular periphery in a cross sectional plane normal to the central longitudinal axis and a peripheral wall structure 14 closing about the central longitudinal axis. The inner and outer surfaces 14*a*, 14*b* of the container wall 14 are cylindrical, concentric, and circular in the aforementioned cross sectional plane, the wall structure or canister body 14 thus having a round annular shape in this plane. The cylindrical container 12 is closed at one end of its annular cylindrical wall structure 14 to define a closed bottom of the container, while the opposite end is not closed so as to leave the top of the container open until the lid 10 is installed thereon.

The lid 10 is a two piece assembly made up of a rim 16 and a circular sheet of resilient flexible material 18 defining a gasket-like element. The rim 16 features a washer-like ring piece forming a planar annular portion 20 having circular inner and outer perimeters and a cylindrical annular flange 22 projecting vertically downward from the planar annular portion 20 at, and fully along, the outer perimeter thereof. The circular gasket 18 has an outer diameter that is less than the inner diameter of the rim's flange 22 and greater than the inner diameter of the planar annular portion 20. Along its outer perimeter, the circular gasket 18 is affixed to the underside of the planar annular portion 20 to span the circular opening bound thereby. The rim 16 is dimensioned to fit over the top end of the container wall 14 so that the flange 22 is slidable downward along the outer surface 14*b* of the container wall 14 to slide the rim's planar annular portion 18 toward the upper end face of annular cylindrical wall structure 14 to position the gasket 18 at the top end of the container 12 against, or at least adjacent to, this upper end face of the container wall 14. With the lid 10 so installed atop the container 12, contact between the outer surface 14*b* of the container wall 14 and the outer surface of the rim flange 22 of the lid 10 limits sliding of the lid 10 in a plane normal to the container's longitudinal axis to keep the lid atop the container in its proper position supporting the gasket 18 over the open top end of the container. It will be appreciated that this function could similarly be provided by three or more separate flanges disposed at spaced locations about the planar annular portion's outer perimeter, rather than the continuous cylindrical annular flange 22 illustrated for the embodiment of FIGS. 2 and 3. For the example, the continuous flange of FIGS. 2 and 3 and an alternate arrangement of three or more distinct flanges projecting from the planar annular portion 20 of the rim 16 at equally spaced apart positions thereabout would each provide flange portions cooperating with the peripheral wall 14 of the container 12 at its outer surface to limit or prevent movement of the lid 10 in radial directions relative to the container's central longitudinal axis.

The gasket 18 situated parallel to the planar annular portion 20 of the rim 16 immediately therebeneath has a central circular hole 24 formed through it. The perimeter of the central hole 24 extends about a central axis of the lid 10 about which the planar annular portion 20 and cylindrical flange 22 concentrically close, this lid axis being aligned with the container's central longitudinal axis when the lid 10 is installed atop the container 12. Eight slits 26 extend radially outward from the central hole 24 in the gasket 18 toward the surrounding flange 22 of the rim 16, thereby defining eight retaining flaps, leaves or fingers 28 projecting toward the central hole 24 from an integral annular perimeter portion 30 of the gasket 18 defining the circular outer perimeter thereof. The slits 26 each taper slightly in width moving radially outward from the central hole 24 and the retaining flaps 28 each taper in width moving along the slits 26 radially inward toward the central hole. At a distal end 26*a* opposite the central hole 24, each slit 26 narrows in width to almost bring the adjacent retaining flaps on opposite sides of the slit into contact. At this narrowest portion of the slit 26 distal to the central hole 24, the slit 26 joins a circular aperture 32 in the gasket 18 that is positioned inward from the inner perimeter of the rim's planar annular portion 20 and is smaller in diameter than the central hole 24.

Figure 1:
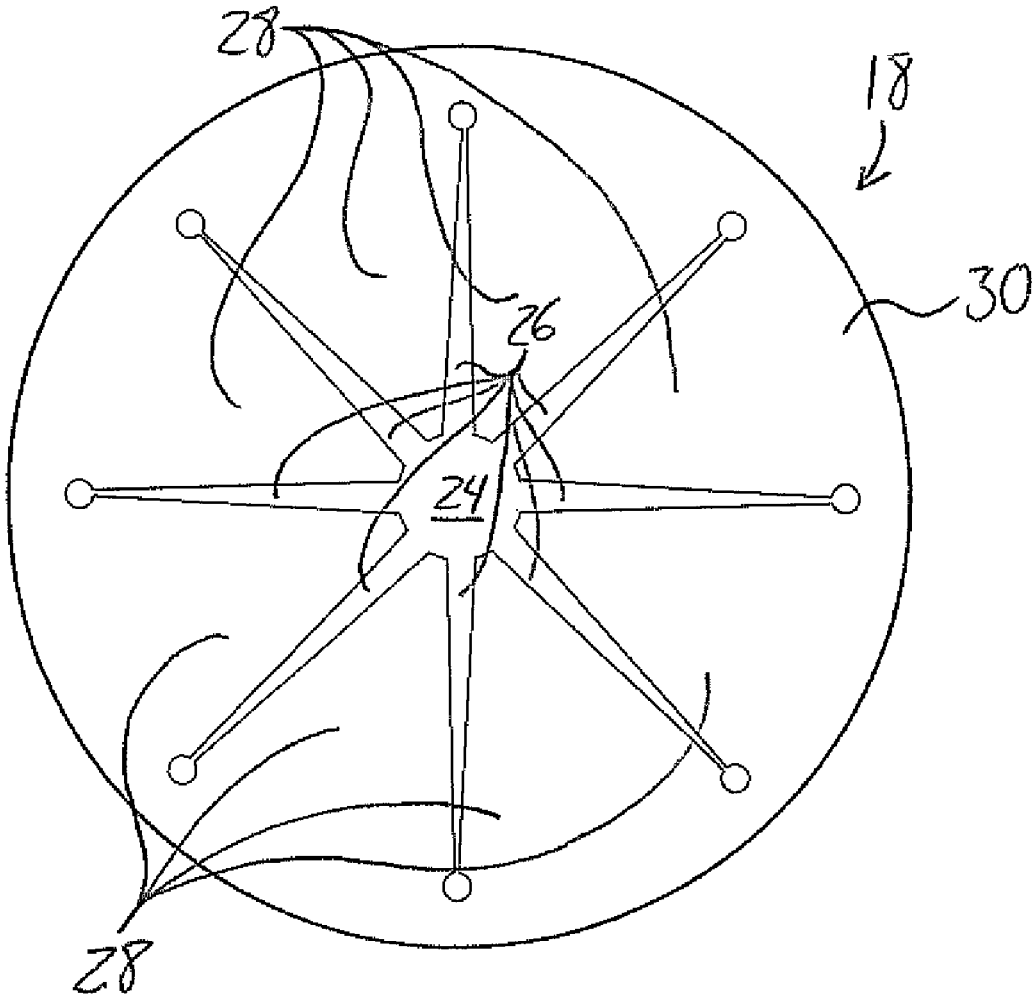
FIG. 1 is a schematic overhead plan view of a rubber gasket of a first embodiment tree stand.
Figure 2:
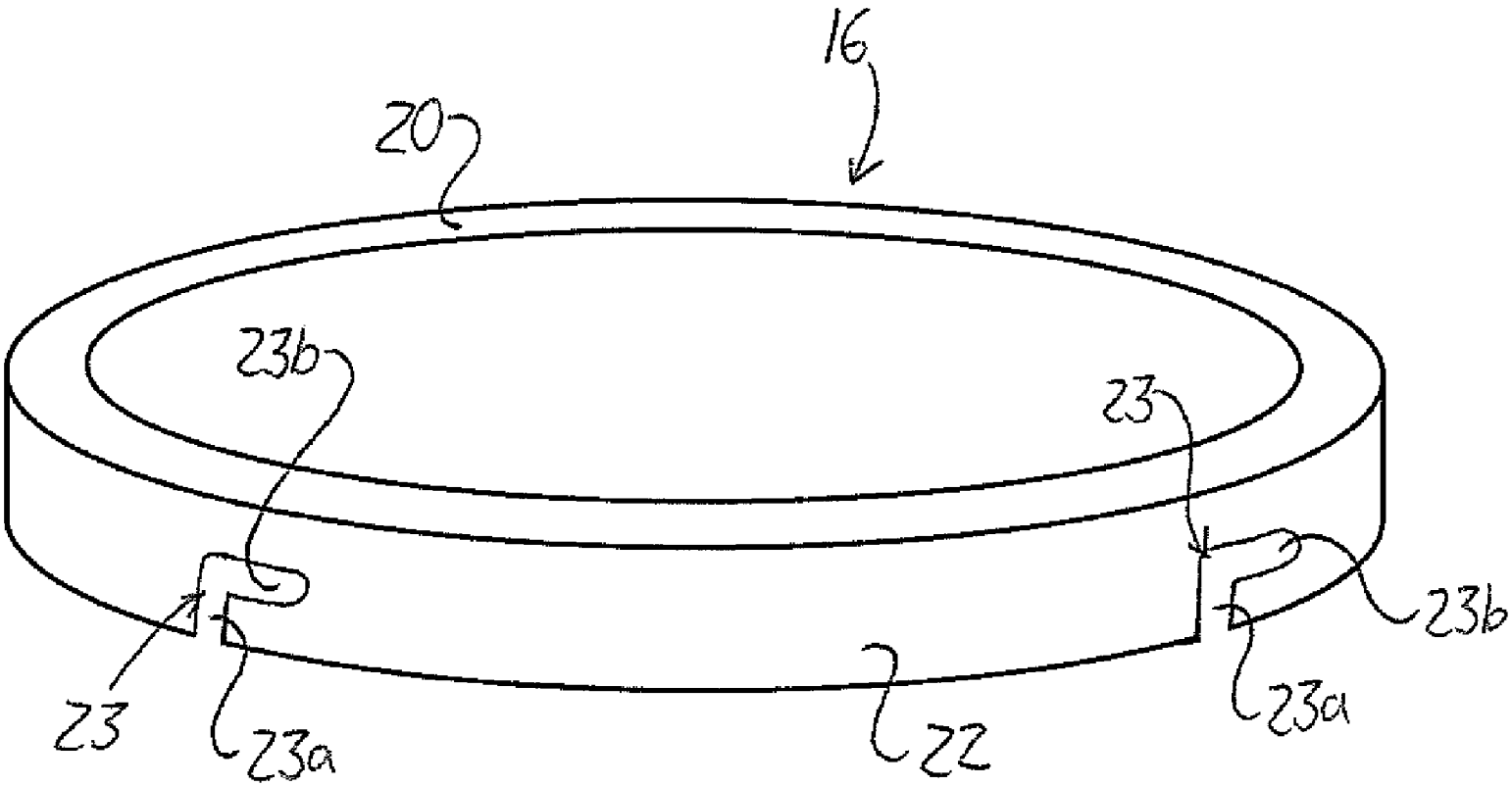
FIG. 2 is schematic perspective view of a rim of the first embodiment tree stand.

With reference to FIGS. 2 to 4, the lid may be lockable to the closed-bottom container. This locking feature may be accomplished by cooperating slots and projections defined on opposite ones of the rim of the lid and the closed bottom container, where the slots and projections are engagable to lock the rim to the closed-bottom container. The cylindrical flange 22 of the ring or rim has slots 23 formed therein for receipt of respective pin or post like projections extending outward from the peripheral wall structure of the closed bottom container during installation of the ring member thereon to lock the ring member to the closed bottom container. Each slot has a first leg 23*a* extending upward into the flange portions and a second leg 23*b* extending from an upper end of the first leg along a perimeter of the ring member, the second legs of the slots extending from the first legs in a same direction along the perimeter of the ring member. The lid is lowered onto the top of the container with the first legs of the slots in the lid aligned with posts 15 projecting radially outward from the outer surface 14*b* of the container wall, which is facilitated by the common angular spacing of the slots and posts about the lid and container peripheries respectively, thereby positioning the posts 15 at the top end of the slots' first legs 23*a*. The lid is then rotated about the aligned axes of the container and lid to achieve sliding of the posts relative to the slots to position the posts at the distal ends of the second legs of the slots opposite the first legs so that the cannot be lifted off the container until an equal reverse rotation of the lid is performed to return the posts to the vertical first legs of the slots. In the illustrated embodiment, the slots and posts are provided in sets of four, the slots or posts of each set being spaced equally around the container axis by ninety degrees from one another, but it will be appreciated that the number of posts and slots may be varied from as little as two of each to over four of each.

To support a cut Christmas tree, the lid 10 is installed atop the container 12 and the cut bottom end of the tree's trunk is lowered into the container by forcing it through the gasket 18. The gasket 18 is intended for use with a tree trunk having a diameter equal to or larger than that of the central hole 24 in the gasket 18 but less than the diameter spanned by the radial slits 26. Forcing the tree trunk end through the gasket 18 by aligning the trunk generally concentrically with the central hole 24 and pushing the trunk end against the gasket at the opening will flex or bend the retaining flaps 28 of the gasket 18 out of their normally planar positions coplanar with the rim-supported perimeter portion of the gasket toward the bottom of the container 12, thereby allowing passage of the trunk end past the retaining flaps 28 toward the container bottom. The resiliency of the gasket sheet 18 biases the retaining flaps back toward their normal positions, thus forcing them upward into engagement against the periphery of the tree trunk. The eight retaining flaps, equally sized and equally spaced about the central hole 24, thus engage the tree trunk from eight different radial directions in diametrically opposed pairs, thereby preventing the tree from tipping and holding it in an upright position with the tree trunk bottom sitting within the container 12 and an debranched lower portion of the trunk passing upward through the gasket 18. The flexibility and resiliency of the gasket 18 accommodates irregularities in the shape of the trunk while providing support at a significant number of positions thereabout. The gasket, which is preferably produced from an appropriately thick rubber sheet, cut with the described pattern to create the retaining flaps will thus conform to the shape and width of the Christmas tree trunk once the trunk has be pushed through the middle opening of the gasket.

The tree stand may be sold with more than one removable lid, each having a differently dimensioned center hole 24 or slits to define differently sized retaining flaps so that the user of the stand can select from among the plurality of interchangeable lids based on the size of tree to be supported. Lids with differently shaped or dimensioned patterns cut therein to change the size or shape of the retaining flaps may additionally or alternatively be sold as separate units, to allow purchase of a new lid for with a tree within a particular trunk diameter range, or to replace a lost or damaged lid assembly. The apertures 32 at the ends of the slits 26 in the lid allow the gasket to achieve an easier return to its original profile after being in use for a period of time. The holes also relieve the stress the gasket material experiences when holding a tree trunk—diminishing the potential occurrence of the tearing of the gasket material through repeated use over years.

Figure 5:
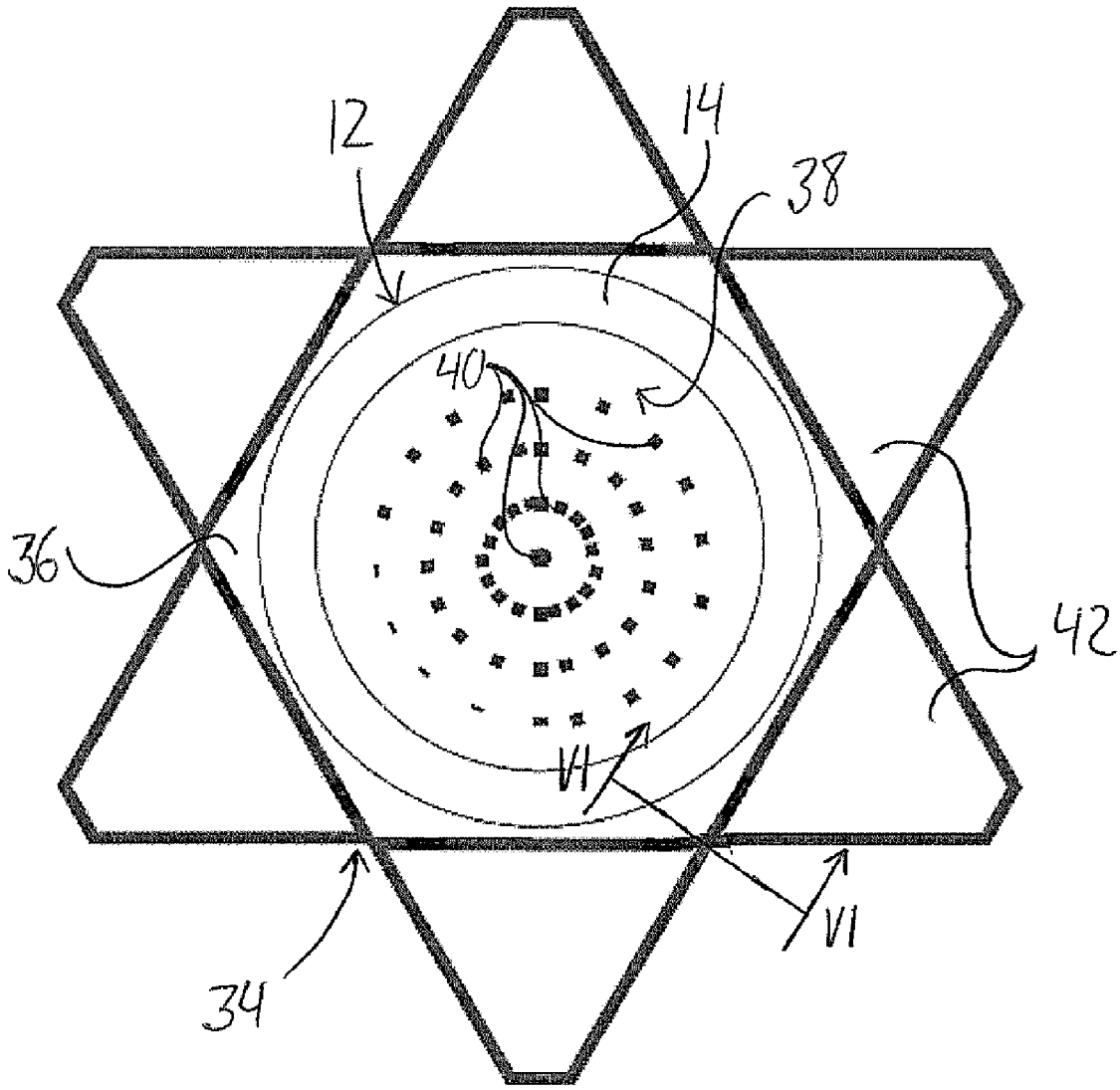
FIG. 5 is a schematic assembled overhead plan view of the first embodiment tree stand with the lid removed and with support flaps of a base assembly of the stand each in a deployed position.

FIG. 5 shows a base assembly 34 atop which the peripheral wall 14 of the container 12 is mounted so that the container is carried on the base assembly 34 for support thereby when the base assembly is positioned on the ground, or another generally horizontal surface. The base assembly 34 features a central plate 36 that is of regular hexagonal shape in plan, having six equally dimensioned sides and six equal internal equals. The central plate 36 is dimensioned so that the annular bottom end face of the container's peripheral wall 14 fits entirely within the perimeter of the central plate 36 along the plane thereof. The container may have an existing closed bottom end, to a bottom face of which the central plate 36 of the base assembly may be fixed, or the central plate 36 can instead be fixed directly to the bottom end of the container wall 14 in a sealing fluid-tight manner to form the container's closed bottom end. Either way, the container bottom end is made watertight so that water can be poured into and stored in the container 12 for consumption by the cut tree. Water can be added to the container 12 prior to installation of the lid 10 thereon and water can be added to the container after installation of the lid 10 and tree by pouring it onto the gasket 18 for passage through the slots 26 therein to the container interior. The thickness or depth of the planar annular portion forms an upwardly extending edge around the top surface of the gasket 18 to prevent water from flowing outwardly off the gasket 18.

Figure 9:
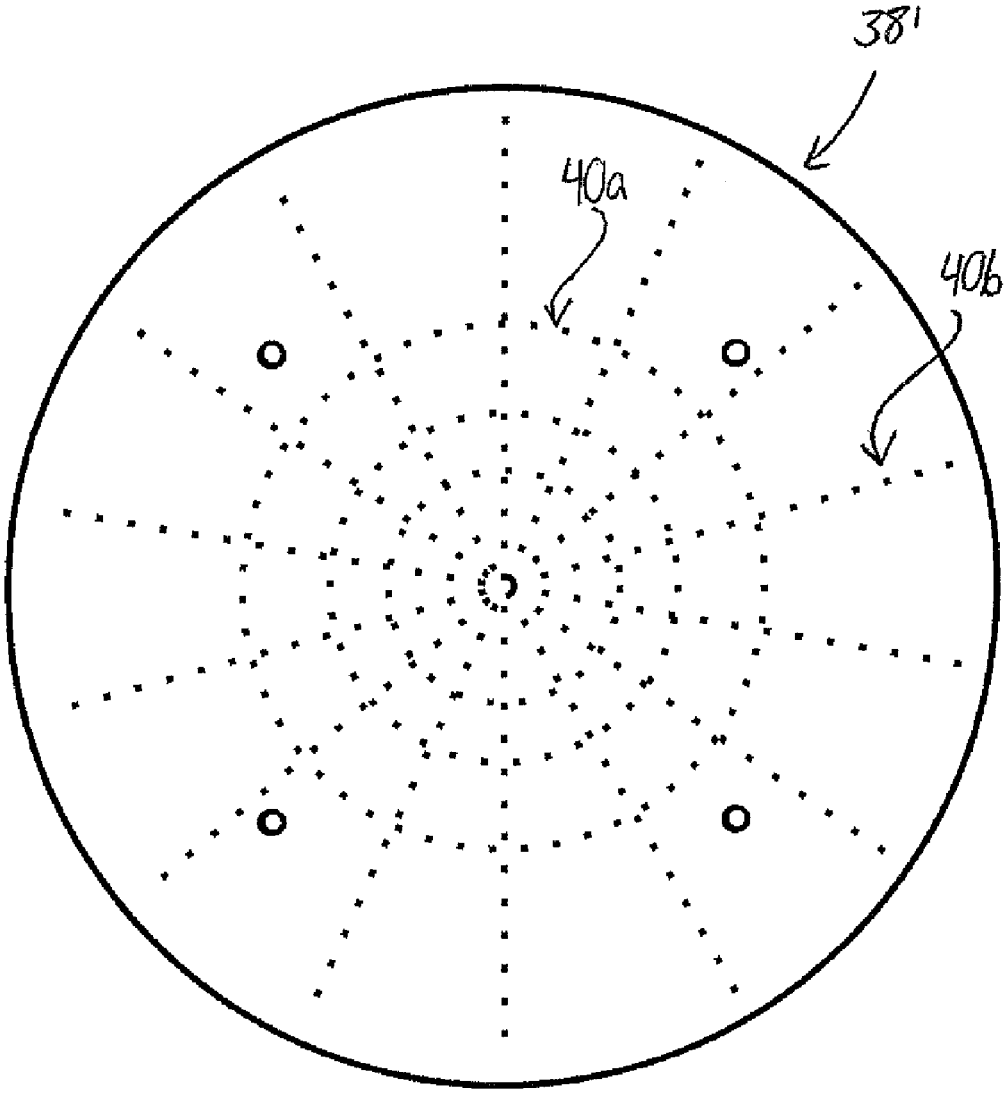
FIG. 9 is a schematic overhead plan view of an alternate embodiment gripper plate for a tree stand according to the present invention.
Figure 10:
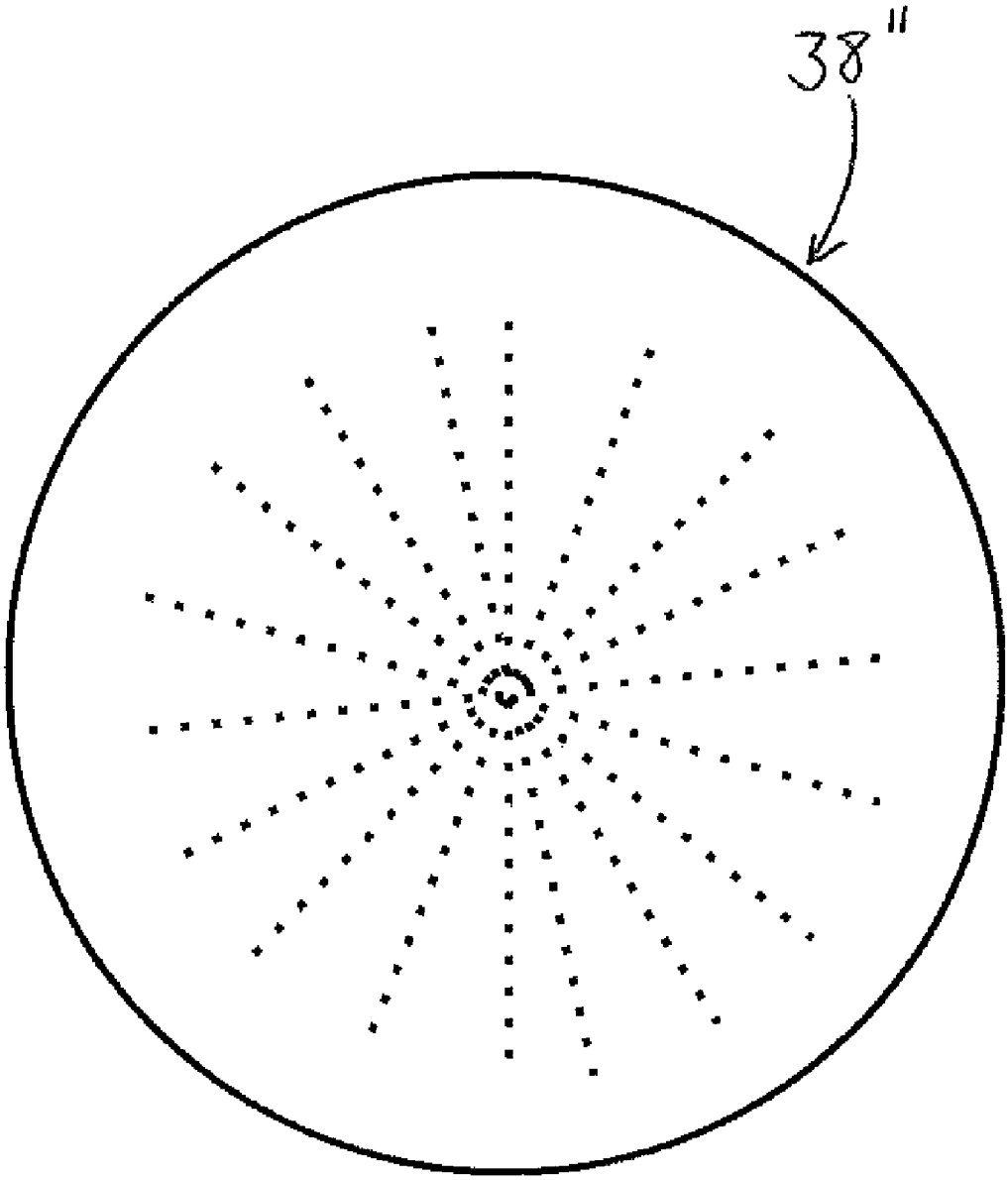
FIG. 10 is a schematic overhead plan view of yet a further alternate embodiment gripper plate for a tree stand according to the present invention.

Within the container interior, a circular gripper plate is fixed atop the closed bottom of the container 12 in a position concentric with the container wall 14 surrounding it. The gripper plate 38 is a plate having a plurality of spikes or pins, schematically shown at 40, fixed thereto to project upward therefrom and present upwardly directed sharpened points thereabove to engage the cut bottom of the tree trunk when lowered into the container from above through the gasket 18 as described herein above. This gripping of the bottom end of the tree trunk assists the retaining flaps 28 of the gasket in maintaining the tree in a desirable upright position and orientation by resisting movement of trunk's bottom end. In other words, the gripper plate acts as an anchoring mechanism for the bottom of the Christmas tree trunk. The gripper plate 38 of the first embodiment tree stand shown in FIG. 5 features pin or spike gripping elements arranged in spaced apart concentric circles around a central gripping element or central closely spaced cluster or array of gripping elements. However, it will be appreciated that the gripping elements may be positioned in any of several different patterns or arrangements. For example, FIG. 9 shows an alternate embodiment gripper plate 38' which in addition to concentric circles of pins or spikes 40*a*, also presents series of linearly arranged gripping elements 40*b* extending through the concentric circles on which the other pins lie in radial directions outwardly away from the center of the gripper plate 38' at equal angular spacings thereabout. FIG. 10 shows a further alternate embodiment gripper plate 38" similar to that of FIG. 5, the pins being arranged in radially extending linear rows at angularly spaced positions about he center axis of the plate.

The spacing apart of the pins along each radius is the same, with each pin at an equal radial distance from the center axis of the plate as a corresponding pin in each other row. The corresponding pins in the different rows at a respective radial distance from the plate center are thus laid out in a circle concentric with the other circles similarly defined by the pins at other radial distances form the plate center. Unlike the gripper plate 38' of FIG. 9, there are no pins at positions between the radial rows. In embodiments where the central base plate is affixed to the bottom of the canister body to act as the bottom watertight seal for the canister body, as well as part of the supporting base of the stand, the gripper plate may be attached to the central base plate prior to installation thereof onto the bottom end of the container wall or canister body.

The central base plate 36 has six rigid support flaps 42 each hinged thereto for movement between a deployed position and a storage position so that these leg flaps may be folded in under the canister body of the stand so as to facilitate easier and more compact storage and packaging. Each support flap 42 is a rigid plate having the shape of an trapezoid or truncated triangle in plan. The longer of the two parallel sides of each trapezoidal support flap 42 defines a base side 42*a* of the support flap 42 that is parallel and adjacent to a respective one of the hexagonal central plate's six sides 36*a*. FIG. 5 shows each support flap 42 in its fully deployed position coplanar with the central base plate 36 and projecting outwardly from the respective side thereof. Each support flap of the illustrated embodiment is an isosceles trapezoid, with the two converging sides 42*b* of the support flap 42 each being parallel to the nearest one of the two sides of the central plate 36 neighbouring the side 36*a* along which the support flap's base side 42*a* extends. This base side 42*a* of the support flap 42 extends nearly the full length of the respective side 36*a* of the central plate 36, so that the assembled central plate 36 and support flaps 42 of the base assembly have the general appearance of a six side pointed star with truncated tips when viewed in plan with the support flaps 42 deployed.

Figure 6:
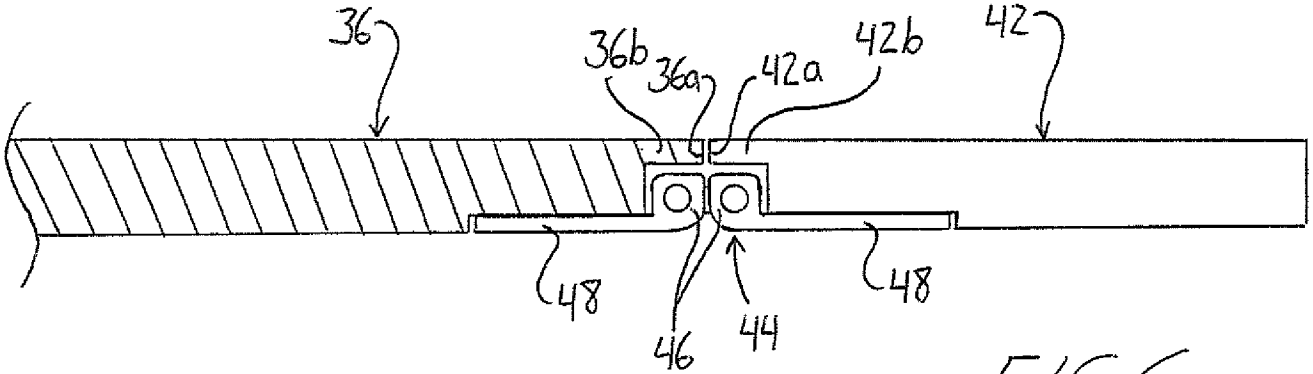
FIG. 6 is a schematic cross sectional view of the base assembly of the first embodiment tree stand as taken along line VI-VI of FIG. 5 with a container wall and gripper plate of the stand removed for ease of illustration.
Figure 7:
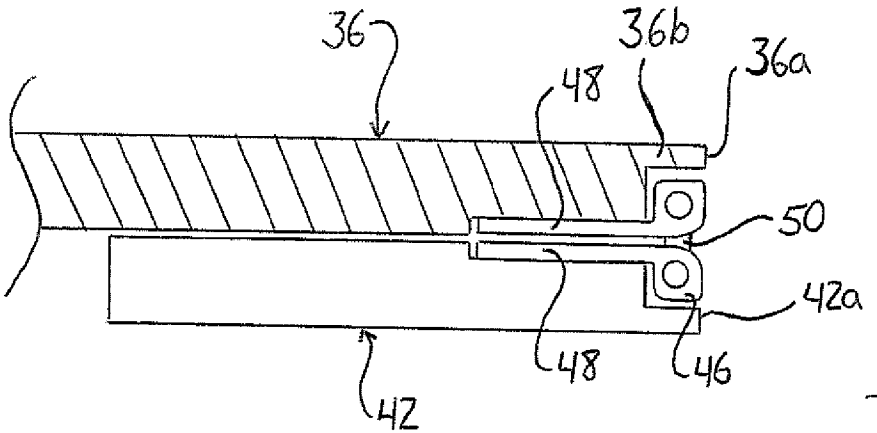
FIG. 7 is a schematic cross sectional view of the base assembly of the first embodiment tree stand similar to FIG. 6, except with the support flap of FIG. 6 in a storage position.

As shown in FIGS. 6 and 7, each support plate 42 of the base assembly is pivotally connected to the hexagonal centre plate 36 at the respective side 36*a* thereof by a hinge 44. In the illustrated embodiment, a card table hinge is used to facilitate movement of the support flap 42 from the deployed position of FIGS. 5 and 6 projecting coplanarly outward from the central plate 36 through 180 degrees to a storage position in which the support flap 42 is positioned face-to-face with the central plate 36 on the side thereof opposite that from which the container wall 14 extends, the support flap now extending inward from the central plate edge 36*a*. The known card table hinge provides a 180 degree stop by shaping of the curls 46 of the hinge leaves 48 to have flat sides that abut against one another when the leaves are opened apart to reach a parallel 180 degrees configuration. In this type of hinge, a pivoted link 50 between the curls of the two leaves facilitates the relative movement between the supporting flap 42 and the central plate 36 from the end-to-end arrangement of the deployed position to the face-to-face arrangement of the storage position.

With reference to FIG. 6, where the supporting flap 42 is in the deployed position, the supporting flap 42 and the central plate 36 are of equal thickness, thus having their top surfaces coplanar with one another and their bottom surfaces likewise coplanar with the retaining flap deployed. The leaves 48 of the hinge 44 are recessed or mortised into the bottom faces of the central plate 36 and supporting flap enough to position the leaves flush with or recessed from the rest of these faces. As a result, no part of the hinge 44 projects outward from these flush faces or surfaces with the supporting flap 42 in the deployed position, so that the deployed supporting flap 42 extends the flat base of the tree stand that would otherwise only be provided by the central plate 36 or bottom of the container 12, increasing the size or diameter of the stand's footprint to improve resistance to tipping of the tree supported by the stand.

As shown in FIG. 6, the central plate 36 and supporting flap 42 may be further recessed to a greater depth than at their hinge leaf mortises at their adjacent side edges 36*a*, 42*a* to form a ledge or projection 36*b*, 42*b* that projects from the rest of the central plate 36 or supporting flap 42 over the respective hinge curl and defines the respective side edge 36*a*, 42*a*. This way, with the supporting flap 42 deployed, the hinges are concealed beneath the central plate 36 and the supporting flap 42 with the hinge curls and joint disposed below the ledges 36*b*, 42*b*. In this arrangement, the side edges 36*b*, 42*b* of the central plate 36 and the supporting flap 42 may also abut against one another at a central position over and between the curls of the two hinge leaves, thereby acting as a 180 degree stop preventing over-pivoting of the supporting flap past the deployed position from the storage position. This may be used in addition to or instead of a stop-providing hinge. On the other hand, the support flap and central plate may alternatively lack the illustrated ledges 36*b*, 42*b* and instead just end at flat facing-together side edges on respective opposite sides of the hinge curls, thereby positioning the hinge curls at a position between the central plate 36 and the supporting flap 42, where they would be visible from above the stand with the supporting flaps deployed.

The above-described and illustrated arrangement has the advantages of the hinges being fully concealed when the support flaps are deployed and the ability to have the support flaps fold right up flat against the central plate 36 in a parallel orientation therewith to provide the most compact storage configuration of the base assembly when the stand is not in use. This way, the tree stand can optionally be stored in the same upright orientation in which it is used to support a tree, as the tree stand can sit atop the flat coplanar support flaps when folded beneath the central plate 36 in their storage positions parallel therewith. Of course the tree stand could alternatively be flipped upside down when not in use to support a tree, at which time the support flaps can simply fold onto the now-upwardly facing side of the central plate 36 opposite the container wall 14 with minimal effort. Also, as shown in FIG. 7, the support flaps and hinges do not project at all past the outer perimeter of the central plate 36 when in the storage position.

It will be appreciated that other hinging arrangements may be used to facilitate folding or pivoting of support flaps into storage and deployed positions. For example, the illustrated stop-providing card table hinge could be used in a position mounted atop rather than beneath the a central plate 36 with the curls projecting to a side of the leaves opposite the central plate 36 and supporting flap 42, each of continuous equal thickness, as long as sufficient space was left between the facing-together side edges 36*a*, 42*a* of the central plate and the deployed supporting flap so that the supporting flap could move from its deployed position parallel to the central plate 36 to a storage position projecting toward the center of the central plate 36 at an oblique angle relative thereto. In this arrangement, the supporting flap could not be folded flush against the central plate 36 in a position parallel thereto, but could at least be moved to a position situating its distal end opposite the hinge at a position inward from the perimeter of the central plate 36. In such an arrangement, the stand would be stored upside down so that gravity would keep the supporting flaps in the storage position sloping upward toward the central longitudinal axis of the upside down container at positions thereabove. In another arrangement, a single-pin stopless link-free hinge could have its leaves mounted atop the central plate and deployed supporting flap with sufficient spacing between the parallel side edges of the central plate and the deployed supporting flap across the hinge's pin-defined pivot axis to again allow the supporting flap to pivot into a storage position not parallel or flush with the central plate, but extending obliquely inward relative thereto toward the central axis thereof. In such an arrangement, a stop may be defined as a rigid stop member projecting outward from the central plate over the hinge knuckle to block pivoting of the support flap past the deployed position coplanar with the central plate. In yet a further alternative, a single-pin stopless link-free hinge could have its leaves mortised into the bottom surfaces of the central plate and the deployed support flap with the leaves coplanarly projecting to opposite sides of the hinge knuckle at a bottom end thereof in the deployed condition so that no part of the hinge lies below the coplanar central plate and support flap with the stand in this condition. The leaves would prevent folding of the support flap into a flush storage position flat against and parallel to the central plate, but pivoting into an oblique storage position with the support flap inclined at an acute angle relative to the central plate would once again be allowed.

Figure 8:
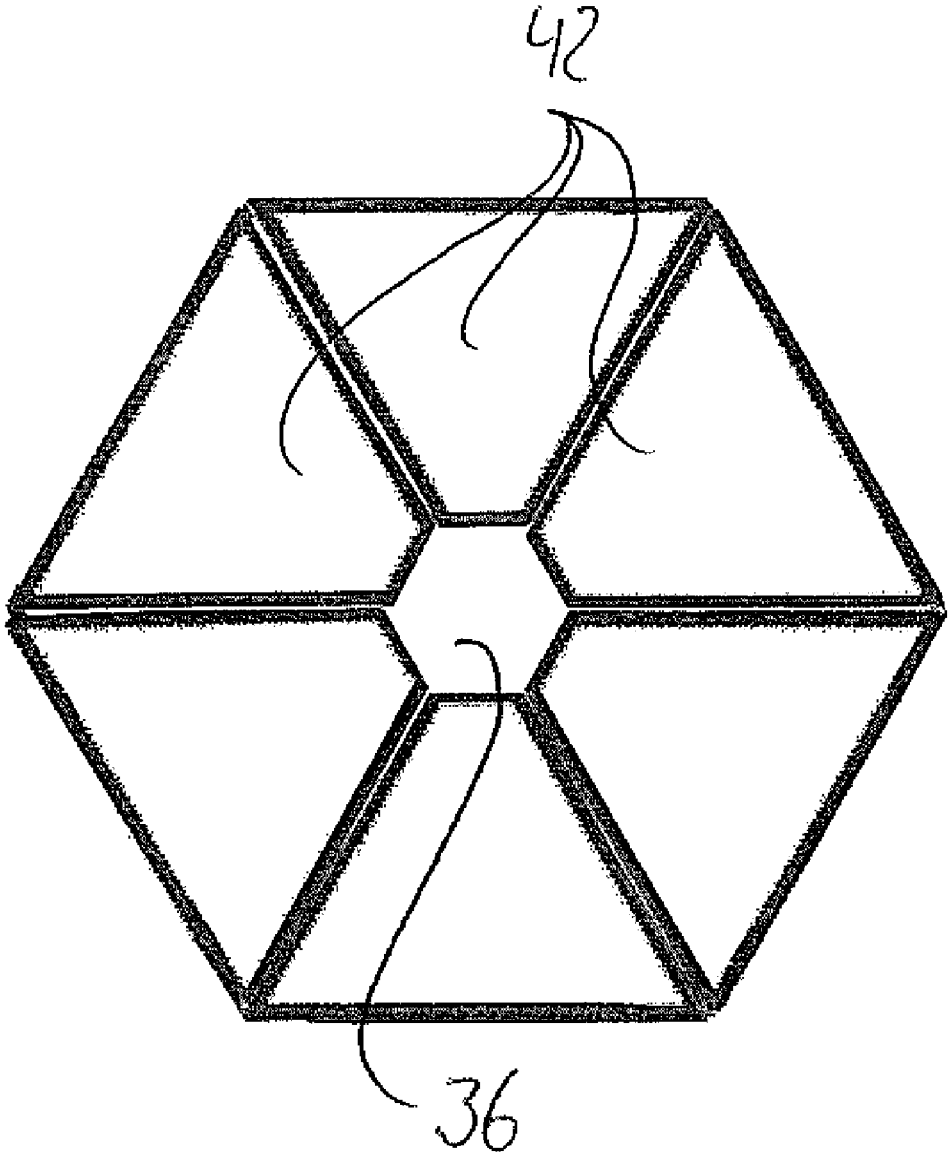
FIG. 8 is a schematic plan view of the bottom of the first embodiment tree stand with the support flaps in their storage positions.

FIG. 8 shows an overhead plan view of the tree stand after being flipped upside down to stand on the container's top end and with the support flaps 42 subsequently pivoted into their storage positions sitting flush on the central plate 36 of the base assembly atop the inverted container. The truncated triangular shape of the trapezoidal support flaps 42 leaves a hexagonal uncovered portion of the central plate 36 at the center thereof, the rest of the central plate 36 being substantially covered by the support flaps 42, except for small spacing left between the adjacent pairs of flaps to avoid interference of one flap with movement of the next and lay out the flaps in a non-overlapping manner in the stand's storage condition. With the hinge configuration illustrated in FIGS. 6 and 7, the supporting flaps 42 and their respective hinges do not project outward beyond the perimeter of the central plate 36 at all in the storage condition, thereby minimizing the horizontal planar area occupied by the stand when not in use to support a Christmas tree.

The tree stand is an all inclusive device which is used for holding a Christmas tree or the like in an upright position. Consisting of a watertight canister shaped main body with extension leg flaps that fold up under the bottom of the canister, and a removable overlapping lid that is comprised of a pattern-cut flexible rubber gasket affixed to—and supported by—a washer type piece with an attached downward protruding flange or collar. Developed as an alternative to complicated and inefficient existing Christmas tree stands that employ screws and or clamping devices to hold the free in place, the invention aims to provide the most efficient and effective tree stand design that allows the user to set-up the Christmas tree with the least amount of effort and with the maximum amount of stability and steadiness. The stand achieves the desired result of an optimally efficient and more effortless Christmas tree stand by employing the existing balanced properties of tensile rigidity and flexibility that are inherent in the rubber gasket material once it has been cut into the pre-tested and affirmed optimal eight-point star pattern. Continuing with the desirability of efficiency and more effortless use, the design of the canister and base plate contribute to the creation of a Christmas tree stand with a minimum of components that work together to deliver the maximum level of effectiveness of function.

It will be appreciated that the shape of the central plate of the base assembly and the shape and number of the support flaps may be varied while still providing supports that are pivotal for movement into and out of deployed positions projecting further outward from the central base than in a storage position in which the flaps project toward the central axis of the central plate. The arrangement of the deployed support flaps projecting outward in a common plane increases the stability of the stand by contacting the ground surface on which the stand is employed over a larger area. It will also be appreciated that the container need not necessarily be of circular or cylindrical, as other cross-sectional shapes could be used and the cross-sectional shape or size could vary over the container's height or longitudinal axis. The annular lid and gasket accordingly need not be circular when produced to fit the corresponding cross-sectional shape of the stand's open top.

The tree stand may be produced with container wall, gripper plate, central plate and supporting flap components of steel or another metal to provide a significant degree of strength, but it may also be possible to produce a sufficiently strong stand using other materials, such as plastic or wood. The container wall, central base and gripper plate may be welded together when metal components are used. Alternatively, the gripper plate may be fastened to the container bottom, which again may be defined by the central plate of the base assembly, using threaded fasteners. For example, the internal gripper plate may be affixed to the top side of the base plate by way of 4 nylon self setting screws threaded into nylon lined receiving holes in the container bottom, which again may be defined by the central base plate 36.

Figure 11:
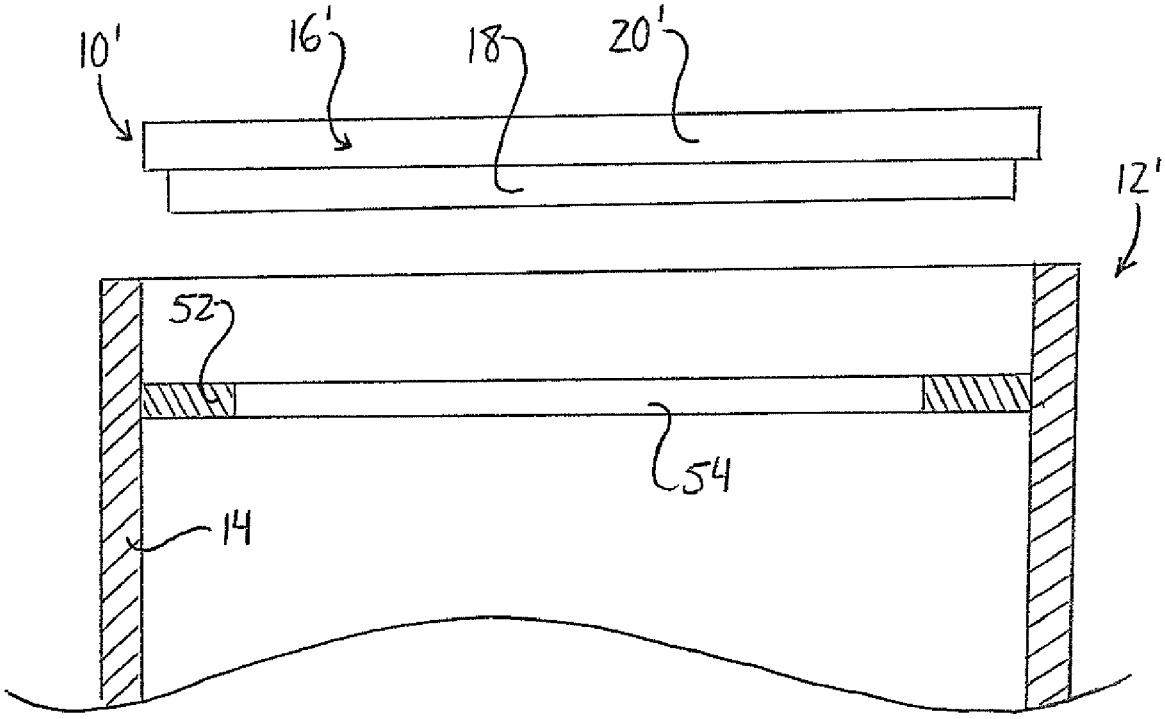
FIG. 11 is a partial exploded side elevational view of a second embodiment tree stand with the container thereof cut away for illustration.

FIG. 11 shows a second embodiment tree stand having a lid 10' and container 12' that differ from those of the first embodiment tree stand of FIGS. 1 to 8. The lid 10' features a rim member 16' that consists of a similar planar annular portion 20' overlying a perimeter portion of the same gasket 18, but lacks the cylindrical flange 22 projecting downward from the outer perimeter of the rim member 20 around the gasket 18. The container 12' differs from that of the first embodiment by the inclusion of annular ledge 52 of projecting a short distance radially inward from the inner surface **14*a* of the cylindrical container wall 14' a short distance below the top end face thereof, leaving a central circular opening 54 through which the tree trunk bottom end passes as the tree is put in place. In the second embodiment, the rim member's planar annular portion 20' has an outer diameter less than the inner diameter of the container wall 14, with the outer diameter of the gasket 18 being equal or less than the rim's outer diameter, but greater than the ring's inner diameter. The lid 10' can thus be lowered into the container interior at the open upper end thereof to sit the gasket 18 and the attached rim 16' atop the ledge 52. With the lid 10' so positioned, the cylindrical wall 14 projects upward to reach and extend slightly past the rim 16' so that contact between the rim's peripheral edge 56 and the surrounding inner surface of the cylindrical wall 14 above the ledge 52 blocks sliding of the lid 10'** from out of its position at or proximate the open top end of the container.

Figure 12:
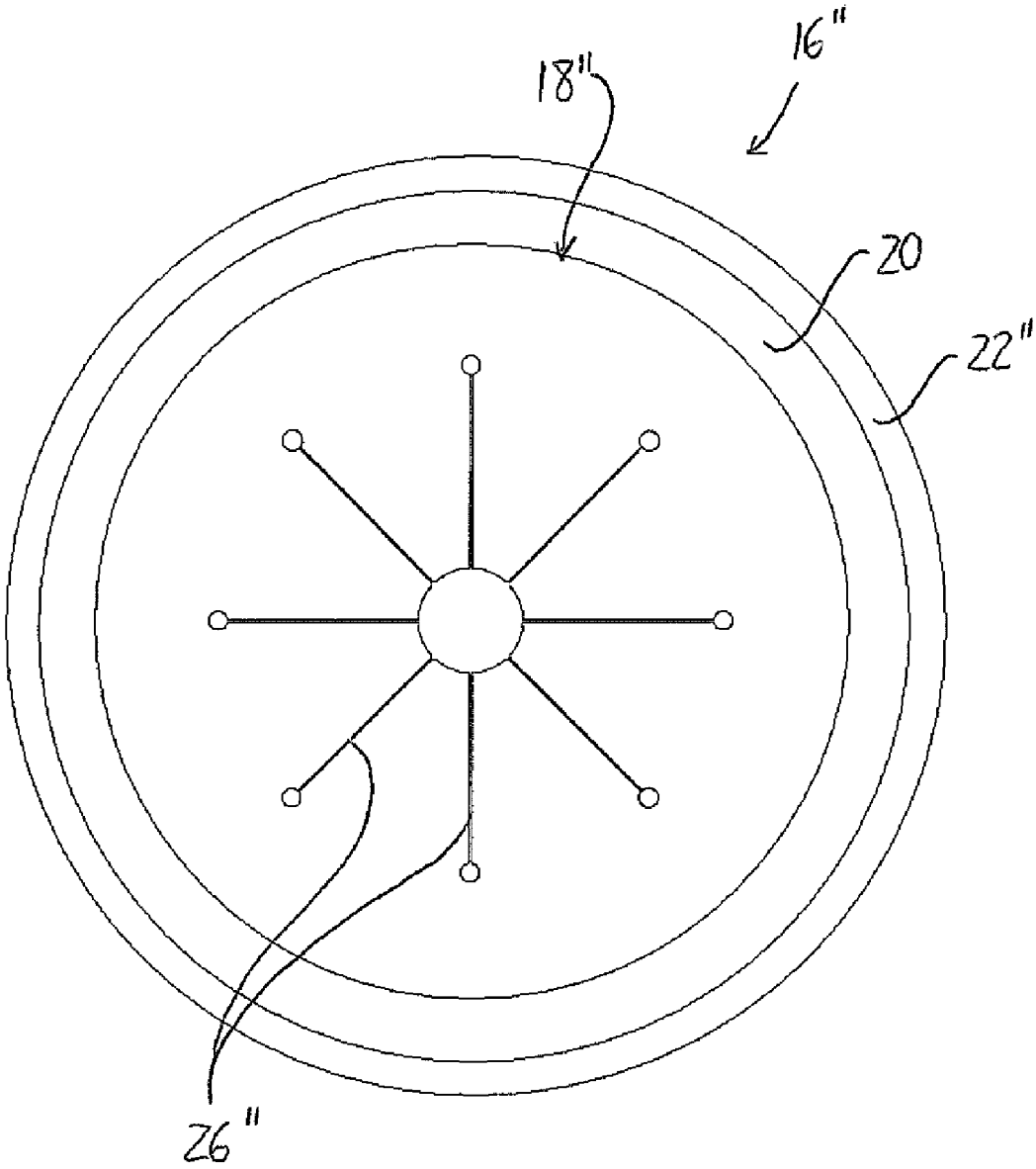
FIG. 12 is a schematic bottom plan view of an alternate embodiment lid.

FIG. 12 shows a further alternate embodiment lid 10" for use on a container like that of FIG. 4, but without the post projections extending radially outward from the container's external periphery surface. The lid flange 22" features no corresponding slots and thus does not lock to post-free container, but rather sits thereatop. As shown in the figure, an annular space is left between the inner surface of the cylindrical flange 22" and the outer perimeter of the gasket 18". The outer diameter of the gasket 18" is smaller than the inner diameter of the cylindrical flange 22" by an amount that allows the top end face of the container's peripheral wall to be received in the space between the flange of the rim or ring member and the gasket attached thereto. The washer-like flat annular portion of the rim 16" thus sits directly atop the top end face of the container's cylindrical periperhal wall. The gasket 18" still has its outer diameter exceeding the inner diameter of the washer like flat annular portion 20 so as to be securable face-to-face thereto by glue or other fastening arrangements. This lid embodiment also differs in that the slits 26" of the gasket 18" do not taper in width, but instead each slots has a uniform width over its length.

A prototype stand was produced with a gasket diameter of approximately seven inches, a gasket thickness of approximately ⅝ inch deep, a rim member of 18 mm steel, a canister with a 18 mm rolled steel body construction that is 7.125 inches in diameter and 6.25 inches high, a gripper plate made of 4-inch diameter 18 mm steel patterned with 0.125-inch high sharpened metallic protrusions or spikes, and a base assembly made of 18 mm steel and having a total outer diameter of 14 inches when the leg flaps are opened. The prototype was found to safely and sturdily support trees ranging in diameter from 1.75 to 3.5 inches.

Figure 14:
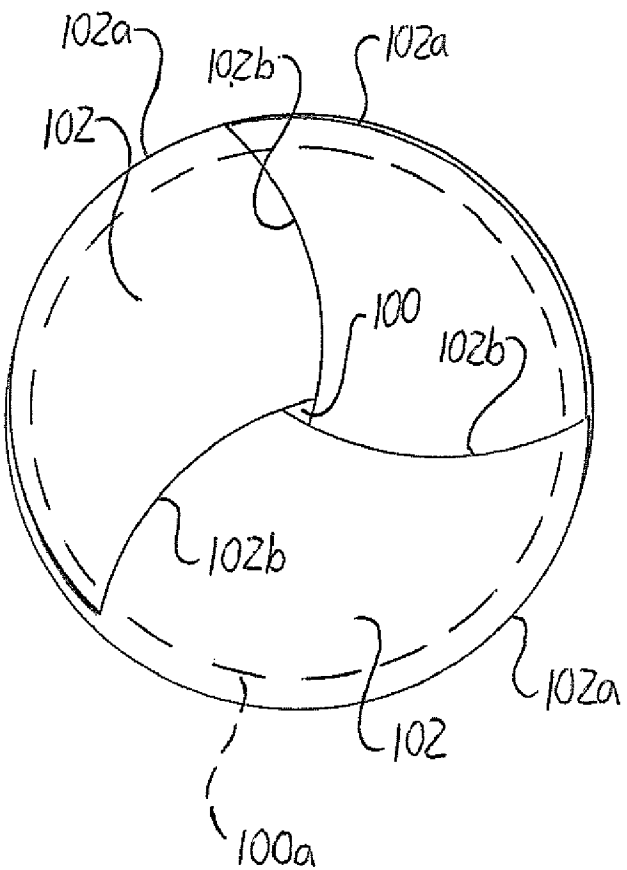
FIG. 14 is a schematic bottom plan view of the base assembly of FIG. 13 with the support flaps thereof retracted to their storage positions.
Figure 13:
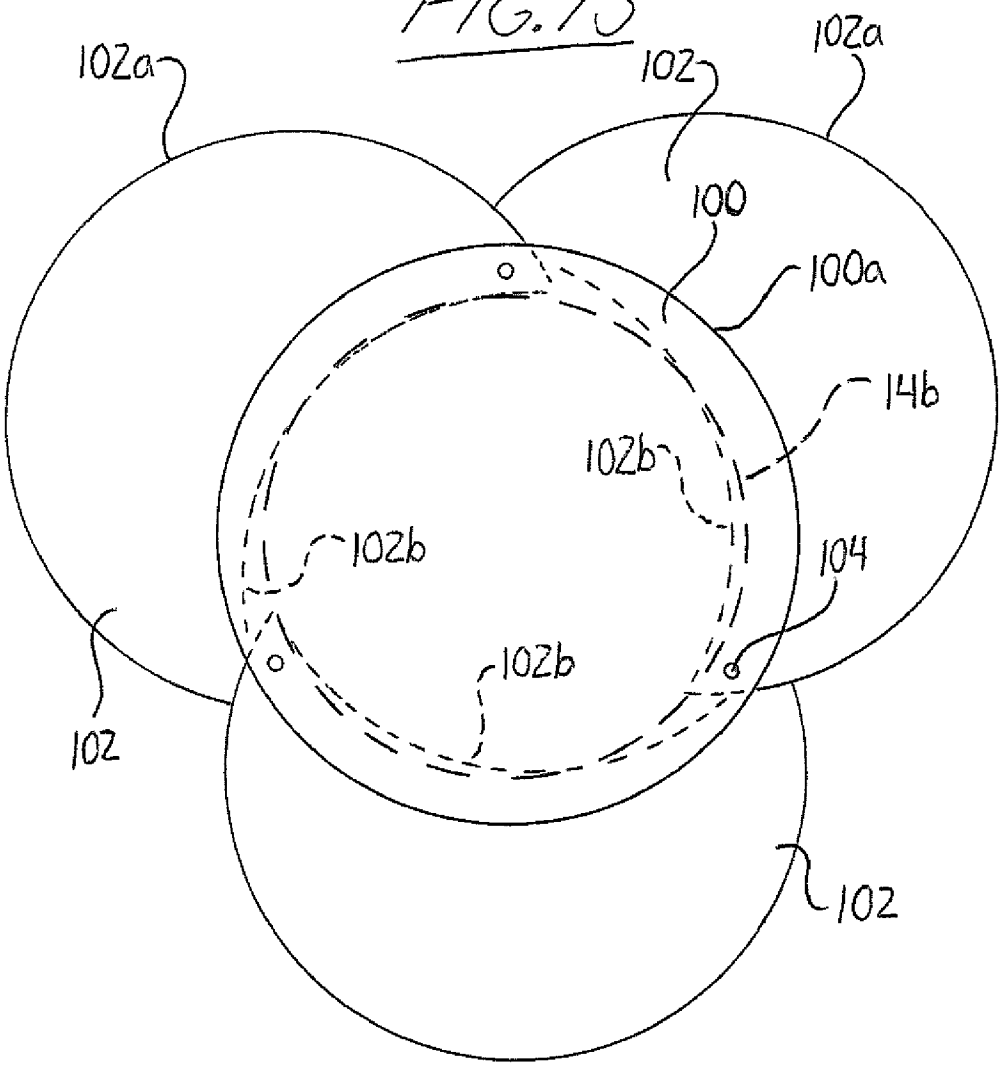
FIG. 13 is a schematic overhead plan view of an alternate embodiment base assembly with support flaps thereof in their deployed positions.

FIGS. 13 and 14 show an alternate embodiment base assembly featuring a central plate 100 that is circular and has a larger diameter than the diameter of the outer surface 14*b* of the container's cylindrical peripheral wall, the container's outer surface 14*b* being represented in broken lines in FIG. 13, so that the container's peripheral wall is once again positioned entirely inward from the perimeter of the central plate 100. Once again, the central plate may form the closed bottom of the container by attachment to the peripheral wall or be fixed to the bottom of an already closed container structure. In this embodiment, the support flaps are not trapezoidal plates hinged for pivotal motion about respective axes parallel to the plane of the central plate, but instead are crescent-like planar flaps 102 movably connected to the central plate 100 for pivotal motion about respective axes normal to the plane of the central plate 100. With reference to FIG. 13 where the three support flaps 102 are shown deployed to project further outward from the central plate 100 than in their storage positions shown in FIG. 14, each crescent-like support flap 102 is carried on the central plate 100 by a pivot pin 104 positioned proximate one of its two points formed at the intersections of its arcuate edges. The three pivot pins 104 are mounted to the central plate 100 between the outer surface 14*b* of the container's peripheral wall and the circular perimeter 100*a* of the central plate at equal radial distances outward from the center of the central plate 100 and at equal angular spacing thereabout. The three support flaps 102 are thus pivotally connected to the base plate at equally spaced positions along the circumference thereof.

Each support flap 102 is supported by the respective pin 104 for pivoting along a plane generally parallel to the plane of the central plate's bottom surface in a position thereadjacent. The two intersecting arcuate edges of each crescent-like support flap 102 have equal radii, each having a radius slightly larger than that of the circular central plate 100, and the planar shape of the flap bound by the two arcuate edges does not contain the radial center of the longer or outer arcuate edge 102*a*. In its deployed position, each support flap 102 has most of its planar surface area and most of the longer arcuate edge's length situated outward from the perimeter of the central plate 100, forming a rounded projection extending outward from the central plate 106 with a bubble-like appearance when the stand is viewed in plan. In the illustrated embodiment, the distal free end of each flap 102 at the horn or point of the crescent-like shape opposite the pivotally anchored end connected to the central plate 100 by the pivot pin 104 is tucked under the anchored end of one of the other two flaps adjacent the flap in question when all flaps are deployed. The anchored end portions of the flaps 102 are coplanar with one another adjacent the bottom surface of the central plate 100, the deviation of the free end portion of each flap from a position completely parallel with the flat bottom face of the central plate 100 being allowed by a small degree of "give" or flexibility in the pivotal connection of the flap and central plate, allowing an effectively rigid planar flap to undergo slight pivoting toward and away from the plane of the base, or in the flap itself, allowing slight flexing of the flap out of a completely planar or flat plate-like condition. The smaller arcuate edge 102*b* of each deployed flap 102 extends generally along, but not parallel to the circular perimeter 100*a* of the central plate 100, having most of its length disposed inward from this central plate's perimeter 100*a*, the anchored end of the flap 102 having its point situated inward of the central plate's perimeter 100*a*.

FIG. 14 shows the crescent-like flaps 102 in their storage positions, having been pivoted about their respective pivot pins 104 to position their longer arcuate edges 102*a* in positions generally concentric with the perimeter edge 100*a* of the central plate at positions slightly outward therefrom. The free end of each flap 102 is tucked further beneath the next flap in one direction about the central plate from the anchored end of this next flap, the flaps thus each having significant overlap with the other two in this position to minimize the projection of the flaps outward from the central plate's perimeter edge 100*a*. The retracted flaps 102 are situated mostly inward from the central plate's perimeter in these storage positions, leaving only a small central portion of the base plate's bottom surface exposed and significantly reducing the footprint of the stand for space-efficient storage thereof when not in use to support a tree.

It will be appreciated that support flaps of other shapes, sizes and number may similarly be installed in a similar manner to pivot or swivel about vertical axes normal to the base plate parallel to the closed bottom of the container between storage positions substantially therebeneath and deployed positions projecting further outward therefrom, and that such flaps may be designed to avoid any overlapping of the flaps, in which case the structure of the flaps may be rigid and entirely planar and pivotal connections to the base with less "play" or "give" may be used. However, a prototype of the base assembly embodiment of FIGS. 13 and 14 produced with 14 gauge steel crescent like support flaps to obtain the good balance between a desirable high degree of base-defining downward-facing surface area when deployed and the opposite desirable compact footprint when retracted for storage was found to provide a stable, reliable base for preventing tipping of a tree supported in the stand.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A tree stand for supporting a cut tree in an upright position by the tree's trunk, the tree stand comprising:

a sheet of flexible resilient material cut to form a plurality of retaining flaps extending inwardly from a perimeter portion of the sheet toward a centre thereof such that the retaining flaps will flex away from the perimeter portion of the sheet under forcing of a cut end of the tree's trunk against the center of the sheet to allow passage of a portion of the trunk therethrough while resiliently biasing back toward the perimeter portion of the sheet to engage a periphery of the tree's trunk; and a support structure comprising a closed bottom container having a base and an open upper end, the sheet being mountable on the container at a distance upward from a plane of the base with the sheet in an orientation extending along said plane such that the tree's trunk passing through the sheet is held by the retaining flaps in a position projecting upwardly away from the plane of the base;

wherein the resilient flexible sheet is selectively lockable to the closed bottom container and removable therefrom.

2. The tree stand according to claim 1 wherein the sheet is mountable and lockable to the closed bottom container at the open upper end thereof.

3. The tree stand according to claim 2 further comprising a ring member on which the sheet is carried, the ring being removably mountable and lockable to the closed bottom container at the open upper end thereof to selectively lock the sheet to the container.

4. The tree stand according to claim 3 wherein sliding of the ring member from the open upper end of the closed bottom container is blocked by a peripheral wall structure thereof.

5. The tree stand according to claim 4 wherein the ring member comprises downward projecting flange portions at different sides of the ring member that project downward along respective sides of the peripheral wall structure of the closed bottom container.

6. The tree stand according to claim 5 comprising slots and projections defined on opposing ones of the downward projecting flange portions of the ring member and the peripheral wall structure of the closed bottom container and cooperable to selectively lock the ring member to the container.

7. The tree stand according to claim 6 wherein each slot has a first vertical portion and a second horizontal portion, the ring member being lockable to the container by lowering the ring member onto the container to move the projections into the first vertical portions of the slots and then rotating the ring member to move the projections along the second horizontal portions of the slots to ends of the second horizontal portions opposite the first vertical portions.

8. The tree stand according to claim 6 wherein the slots are defined in the flange portions of the ring member and the projections are defined on the peripheral wall of the container.

9. The tree stand according to claim 1 wherein each retaining flap tapers in width from the perimeter portion of the sheet toward the center thereof.

10. The tree stand according to claim 1 wherein spacing between adjacent retaining flaps tapers away from the center of the sheet toward the perimeter portion thereof.

11. The tree stand according to claim 1 wherein the resilient flexible sheet comprises eight retaining flaps.

12. The tree stand according to claim 1 comprising at least one additional sheet of flexible resilient material, each sheet having differently dimensioned retaining flaps to accommodate a differently sized tree trunk, whereby a user can pick from among the sheets of flexible resilient material to suit dimensions of a particular tree.

13. The tree stand according to claim 1 wherein the resilient flexible sheet comprises rubber.

14. The tree stand according to claim 1 wherein the resilient flexible sheet is more than ¼-inch thick.

15. The tree stand according to claim 1 wherein the resilient flexible sheet is more than ½-inch thick.

16. The tree stand according to claim 1 wherein the base comprises a central portion defining the plane of the base and having a plurality of support flaps pivotally secured thereto for movement between storage positions adjacent a bottom side of the central portion opposite where the support structure is arranged to support the flexible resilient sheet and deployed positions projecting outward from the central portion in different directions along the plane of the base further than when in the storage positions.

17. The tree standing according to claim 16 wherein each support flap is pivotal about a respective axis parallel to the plane of the base.

18. The tree standing according claim 16 wherein each support flap is pivotal about a respective axis normal to the plane of the base.

19. A tree stand for supporting a cut tree in an upright position by the tree's trunk, the tree stand comprising:

a support structure defining a base; and a trunk engaging feature carried on the support structure and arranged to engage with the tree's trunk above the base to hold the cut tree in the upright position projecting away from the base;

the base comprises a central portion defining a plane of the base and having a plurality of support flaps pivotally secured thereto, the support flaps being movable, when the stand is not in use to support the tree, between storage positions adjacent a side of the central portion opposite the trunk engaging feature and deployed positions projecting outward from the central portion in different directions along the plane of the base.

* * * * *